US007018251B2

(12) United States Patent
Iwakami et al.

(10) Patent No.: US 7,018,251 B2
(45) Date of Patent: Mar. 28, 2006

(54) TRIM OPERATING WIRE STRUCTURE FOR PERSONAL WATERCRAFT

(75) Inventors: Hiroshi Iwakami, Wako (JP); Tomohiro Fuse, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/660,227

(22) Filed: Sep. 10, 2003

(65) Prior Publication Data

US 2004/0127114 A1 Jul. 1, 2004

(30) Foreign Application Priority Data

Sep. 11, 2002 (JP) ..... 2002-265694

(51) Int. Cl.
*B63H 11/113* (2006.01)

(52) U.S. Cl. ..... 440/42; 440/38

(58) Field of Classification Search ..... 440/38, 440/40, 41, 42, 43; 74/500.5, 502.5
See application file for complete search history.

(56) References Cited

U.S. PATENT DOCUMENTS

| | | | | | |
|---|---|---|---|---|---|
| 5,474,007 | A | * | 12/1995 | Kobayashi | 440/42 |
| 5,540,174 | A | * | 7/1996 | Kishi et al. | 114/291 |
| 6,350,163 | B1 | * | 2/2002 | Fujimoto | 440/1 |
| 6,875,065 | B1 | * | 4/2005 | Tsuchiya et al. | 440/42 |

FOREIGN PATENT DOCUMENTS

| | | | | |
|---|---|---|---|---|
| JP | 6-156379 | * | 6/1994 | 440/41 |
| JP | 8-156887 | * | 6/1996 | |
| JP | 9-281132 | | 10/1997 | |

* cited by examiner

*Primary Examiner*—Sherman Basinger
(74) *Attorney, Agent, or Firm*—Hamre, Schumann, Mueller & Larson, P.C.

(57) ABSTRACT

A trim operating wire is disclosed wherein the length of the pull wire connecting between the push-pull converter and the trim operating lever can be made short, and the push wire can be made long. As a result, even where the pull wire, which is thin and highly flexible, is disposed in the state of being bent at several portions thereof, the sliding resistance of an inner wire of the pull wire is small, and operability is enhanced.

5 Claims, 7 Drawing Sheets

TRIM OPERATING WIRE STRUCTURE FOR PERSONAL WATERCRAFT

FIELD OF THE INVENTION

The present invention relates to a trim operating wire structure for a personal watercraft.

BACKGROUND OF THE INVENTION

A conventional trim operating wire structure comprises a pull wire and a push wire connected to each other through a push-pull converter, which is disposed substantially at the center of a personal watercraft (see, for example, Japanese Patent Laid-open No. Hei 9-281132 (JP 9-281132) (p. 3; FIG. 1)).

FIG. 7 is an illustration of a conventional watercraft constitution (a copy from FIG. 1 of JP 9-281132).

In the conventional cable constitution, two pull cables (not shown) connected to the side of a steering handle 8 and a push/pull cable (not shown) connected to a nozzle deflector 19 are connected through a trim conversion mechanism 25 disposed substantially at the center of the overall length of a hull 2. The pull cable is pulled by turning of a left-side grip of the steering handle 8, and the push/pull cable is pushed or pulled.

In the conventional cable constitution as above, the pull cables each comprise an inner wire passed inside, and are used in an environment in which they are bent. Therefore, when the inner wires are slid, the sliding resistance is liable to increase, making the device more difficult to operate.

In addition, in the case of the inner wires of the pull cables, the sliding resistance of the inner wires is liable to increase with aging, making it necessary to exert a large force by the wrist at the time of turning the left-side grip to simultaneously operate the two inner wires so as to pull one of the inner wires and to push the other.

Furthermore, the inner wires elongate with aging, such that appropriate adjustments are required.

Therefore, a need exists for a trim operating wire structure for a personal watercraft with enhanced operability.

SUMMARY OF THE INVENTION

In an embodiment, a trim operating wire structure is provided for a personal watercraft including a jet propeller for ejecting jet water, a nozzle capable of adjusting the jet direction of the jet water, the nozzle being arranged for the jet propeller, and a trim operating lever provided additionally to a steering handle. The nozzle being vertically swingable (rotatable) from a first ordinary direction when the trim operating lever is gripped, and the nozzle returning to the first ordinary direction when the grip on the trim operating lever is released, wherein one end of a pull wire which is thin and highly flexible is connected to the trim operating lever, the other end of the pull wire is connected to one end of a push wire, which is thick and poorly flexible, through a push-pull converter, the other end of the push wire is connected to the nozzle, and the push-pull converter is disposed in the personal water craft body at a position directly under or on the bow side of the steering handle.

Since the push-pull converter is disposed in the craft body at the position directly under or on the bow side of the steering handle, the length of the pull wire connecting between the push-pull converter and the trim operating lever can be made short, and the push wire can be made long. As a result, even where the pull wire, which is thin and highly flexible, is disposed in the state of being bent at several portions thereof, the sliding resistance of an inner wire of the pull wire is small, and operability can be enhanced.

In addition, since the length of the pull wire, which is thin and highly flexible, is made short, "play" due to bending and delay of response due to elongation of the inner wire can be reduced, and operability can be enhanced.

At the same time, the push wire is made long in a rectilinear form, so that the sliding resistance of the inner wire of the push wire is little changed, and maintenance of operability can be achieved.

In an embodiment, a steering shaft for supporting the steering handle is disposed in the personal water craft body in an inclined position with its upper portion located to the rear of its lower portion, a handle cover for covering the steering handle and the steering shaft is provided, and the pull wire is disposed on the inside of the handle cover.

Since the pull wire is passed through the inside of the handle cover, appearance is enhanced.

In addition, the pull wire disposed along the steering shaft is extended forwardly downward or straight downward from the steering handle, and the push-pull converter is disposed in a place to which the pull wire is extended, so that the pull wire can be made short.

While the invention is susceptible to various modifications and alternative forms, specifics thereof have been shown by way of example and drawings, and will be described in detail. It should be understood, however, that the invention is not limited to the particular embodiments described. On the contrary, the intention is to cover modifications, equivalents, and alternatives falling within the spirit and scope of the invention.

DETAILED DESCRIPTION OF THE INVENTION

An embodiment of the present invention will be described below based on the accompanying drawings. The drawings are to be looked at according to the posture of symbols.

Figure 1:
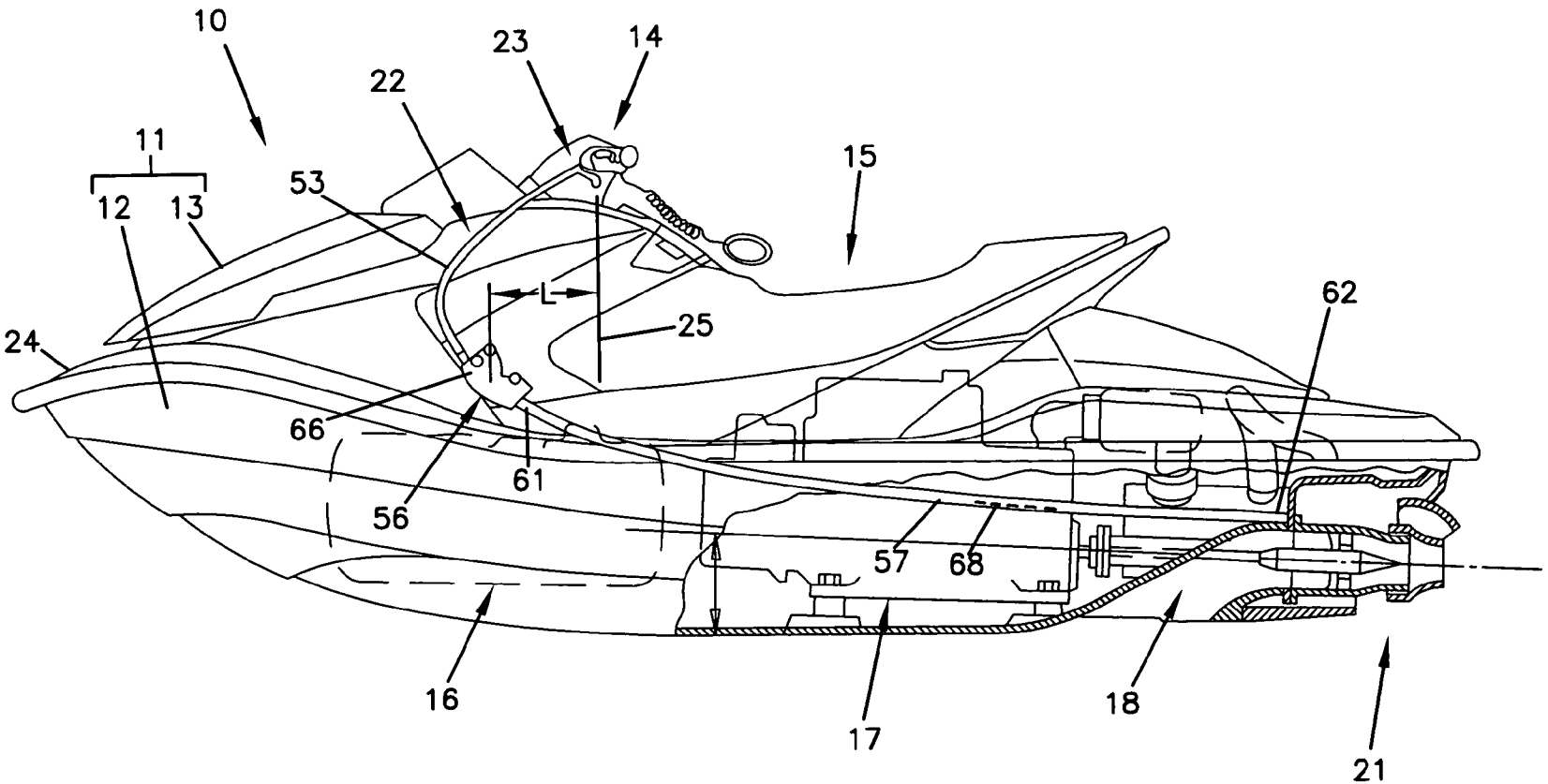
FIG. 1 is a side view of a personal watercraft using a trim operating structure according to the present invention.

FIG. 1 is a side view of a personal watercraft using a trim operating structure according to the present invention. The personal watercraft 10 comprises a craft body (personal watercraft body) 11 composed of a hull 12 and a deck 13 joined to the upper side of the hull 12, a steering handle 14 disposed near the center of the deck 13, a seat 15 provided on the rear side of the steering handle 14 and mounted on the deck 13, a fuel tank 16 and an engine 17 mounted on the center of the hull 12, a water jet propeller 18 connected to the engine 17, a steering nozzle 21 provided on the rear side of the water jet propeller 18, a trim operating wire 22 connected to the steering nozzle 21, and a trim operating lever device 23 provided additionally to the steering handle 14 for connection of the trim operating wire 22. Symbol 24 denotes a bow, and 25 denotes an axis located directly under the steering handle 14.

A steering shaft for supporting the steering handle 14 is disposed in the craft body 11 in the state of being inclined with its upper portion located to the rear of its lower portion, a handle cover 14*b* for covering the steering handle 14 and the steering shaft is provided, and a pull wire 53 is disposed on the inside of the handle cover 14*b*.

Figure 2:
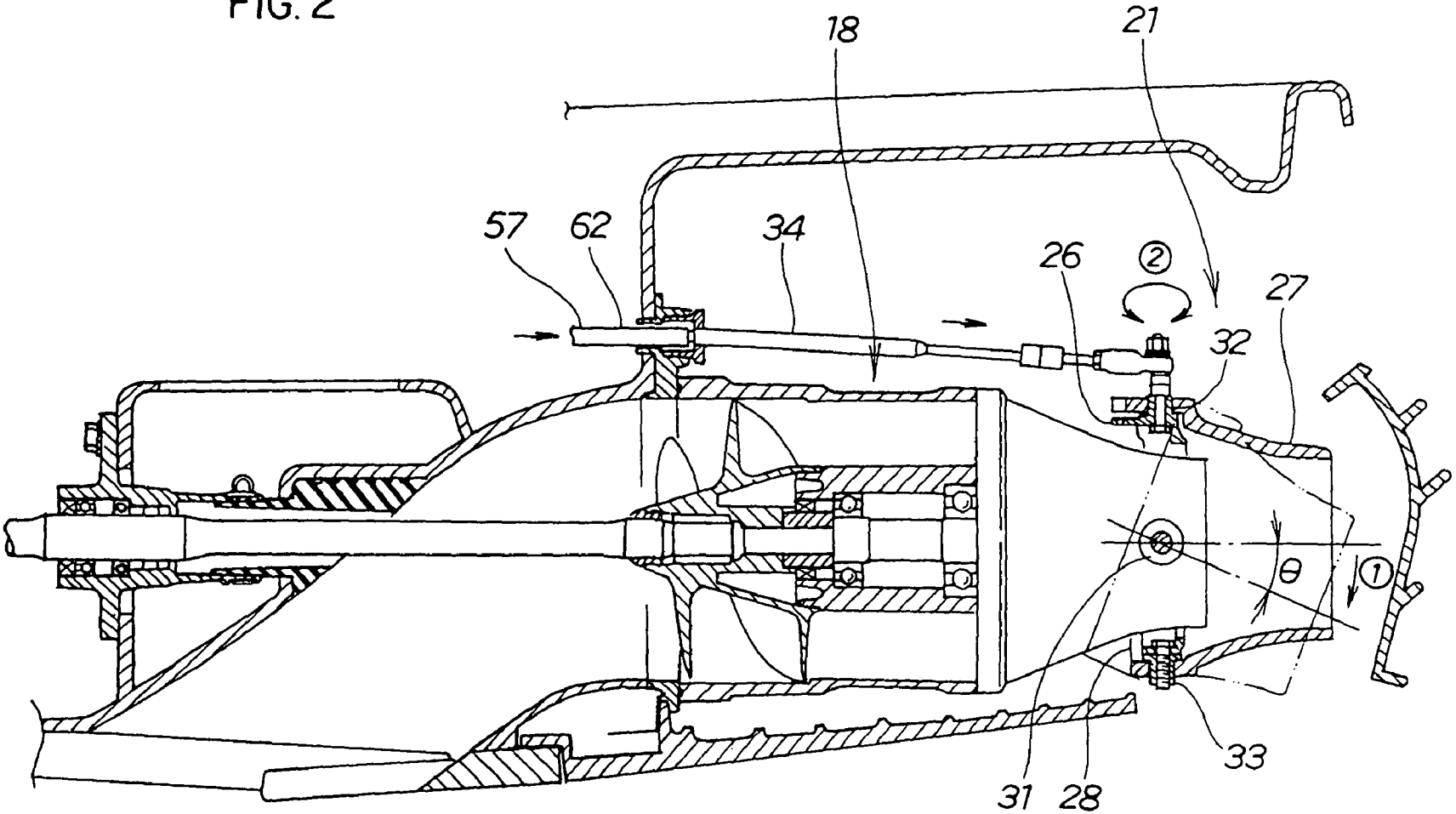
FIG. 2 is a sectional view of a steering nozzle according to the present invention.

FIG. 2 is a sectional view of the steering nozzle according to the present invention, and shows the condition where the steering nozzle 21 is directed in a first ordinary direction.

The steering nozzle 21 comprises a ring member 26 mounted onto the water jet propeller 18 so as to be oscillatable (rotatable) in the downward direction (the direction of arrow ①), and a nozzle main body 27 mounted onto the ring member 26 so as to be oscillatable in the left-right direction (the directions of arrows ②), and has the function of adjusting the jet direction of jet water.

The ring member 26 has a structure in which first receiving portions 31 are provided on the left and right sides (the front and back sides of the figure) of the ring main body 28 so as to be in connection with the water jet propeller 18, and second receiving portions 32 and 33 are provided on the upper and lower sides so as to be in connection with the nozzle main body 27. Symbol 34 denotes a connection member between push wire 57 and the second receiving portion 32, and θ denotes the trim swing angle at the time when the nozzle main body 27 is swung downwards from the first ordinary direction together with the ring member 26.

Figure 3:
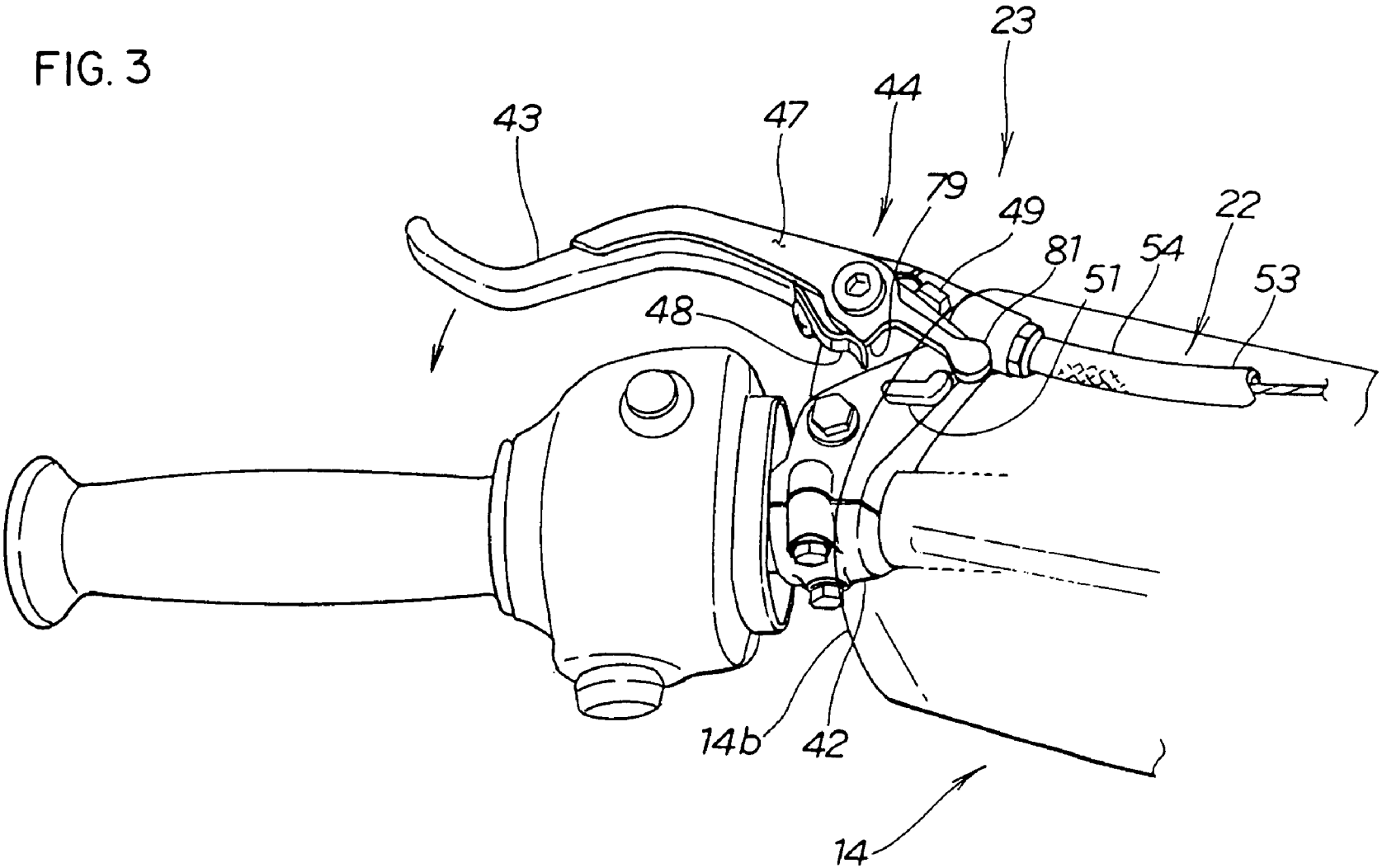
FIG. 3 is a perspective view of a trim operating lever device according to the present invention.

FIG. 3 is a perspective view of the trim operating lever device according to the present invention, and shows the condition where the trim operating lever device 23 is not being operated. The ring member 26 (see FIG. 2) and the nozzle main body 27 (see FIG. 2) of the water jet propeller with the trim operating wire 22 connected thereto are directed in the first ordinary direction indicated by the solid line.

FIG. 3 also shows the condition where the handle cover 14*b* for covering the steering handle 14 and the steering shaft is provided, and a pull wire 53 is disposed on the inside of the handle cover 14*b*. Here, only the handle cover 14*b* is shown in perspective, for easy understanding.

The trim operating lever device 23 is comprised of a support member 42 attached to the steering handle 14, a trim lever main body 43 as a trim operating lever oscillatably mounted onto the support member 42, and a lever lock means 44 for locking the trim lever main body 43.

The lever lock means 44 is for locking the trim lever main body 43 in a specific position, and is comprised of a lock lever 47 oscillatably mounted onto the trim lever main body 43, a spring plate 48 fixed to the trim lever main body 43 so as to latch the lock lever 47 therewith, an origin stopper 49 formed on the trim lever main body 43, and an latch projected portion 51 formed on the support member 42.

Figure 4:
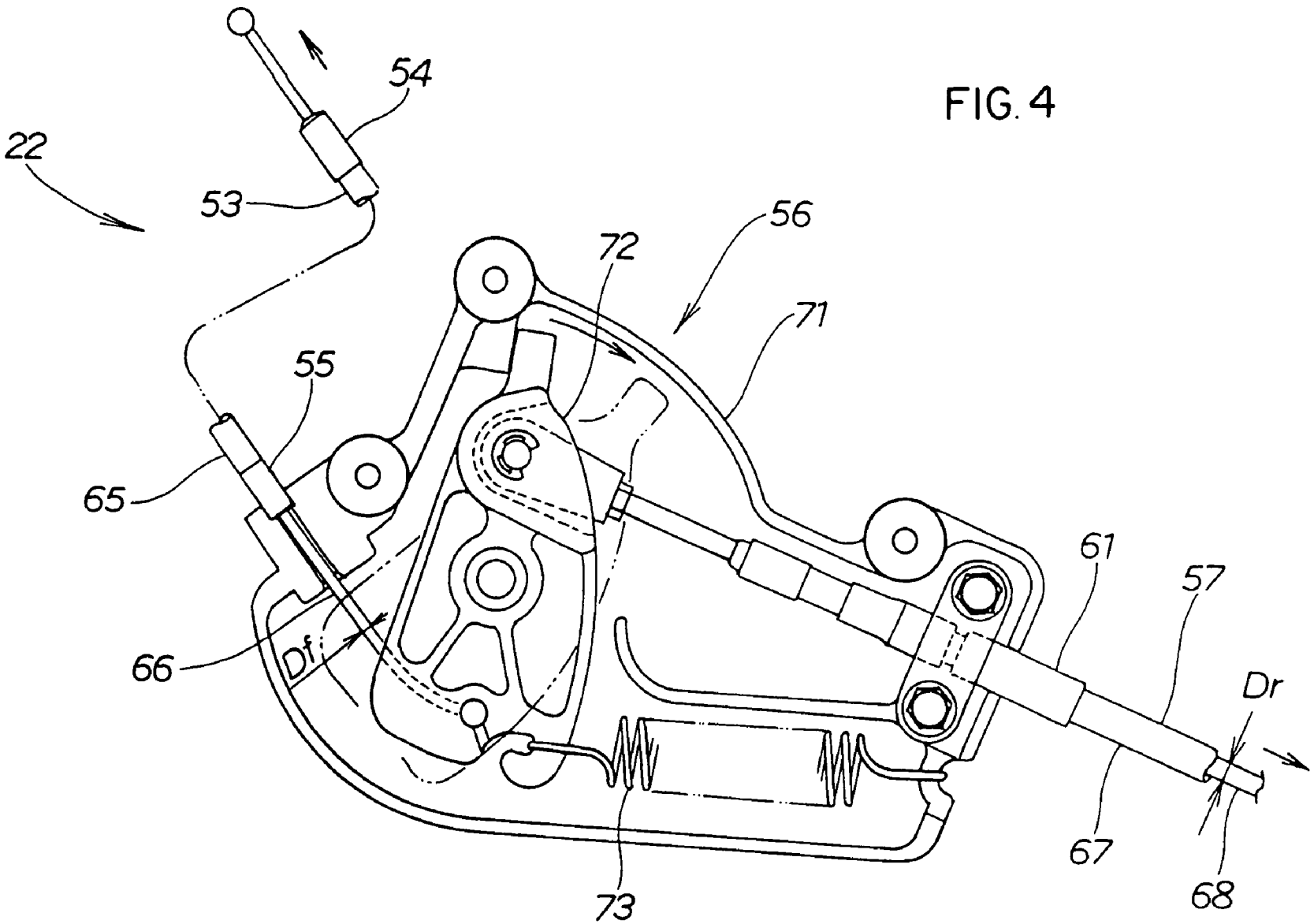
FIG. 4 is a side view of a trim operating wire according to the present invention.

FIG. 4 is a side view of the trim operating wire according to the present invention. The trim operating wire 22 has a structure in which one end 54 (a first end) of the pull wire 53 which is thin and highly flexible is connected to the trim operating lever device 23 (see FIG. 3), the other end 55 (a second end) of the pull wire 53 is connected to one end 61 (a first end) of a push wire 57 which is thick and poorly flexible through a push-pull converter 56, and the other end 62 (see FIG. 2) (a second end) of the push wire 57 is connected to the steering nozzle 21 (see FIG. 2) as the nozzle, and has the function of transmitting a force for operating the steering nozzle.

The pull wire 53 is comprised of a wire cable outer 65 and an inner wire 66. The diameter of the inner wire 66 has been set to be Df.

As the material of the inner wire 66, for example, stainless steel is used.

The push wire 57 is comprised of a wire cable outer 67 and an inner wire 68. The diameter of the inner wire 68 has been set to be Dr. The diameter Dr satisfies the relation Dr>Df.

As the material of the inner wire 68, for example, stainless steel is used.

The push-pull converter 56 has a structure in which a conversion link lever 72 is oscillatably mounted in a box 71, a tension spring 73 is hooked on the conversion link lever 72, the inner wire 66 of the pull wire 53 is connected to one end of the conversion link lever 72, and the inner wire 68 of the push wire 57 is connected to the other end of the conversion link lever 72, whereby a pulling force of the pull wire 53 is converted into a pushing force acting on the push wire 57. Incidentally, the wire cable outer 65 of the pull wire 53 is fixed to one side of the box 71, whereas the wire cable outer 67 of the push wire 57 is connected to the other side of the box 71, and the respective inner wires 66 and 68 are slid within the respective cable outers.

As shown in FIG. 1, the push-pull converter 56 is disposed in the craft body on the bow 24 side of the axis 25 located directly under the steering handle 14 of the personal watercraft 10, at a position spaced from the axis 25 by a distance L. However, the position of arrangement of the push-pull converter 56 may also be directly under the steering handle 14, namely, on the axis 25.

Figure 5:
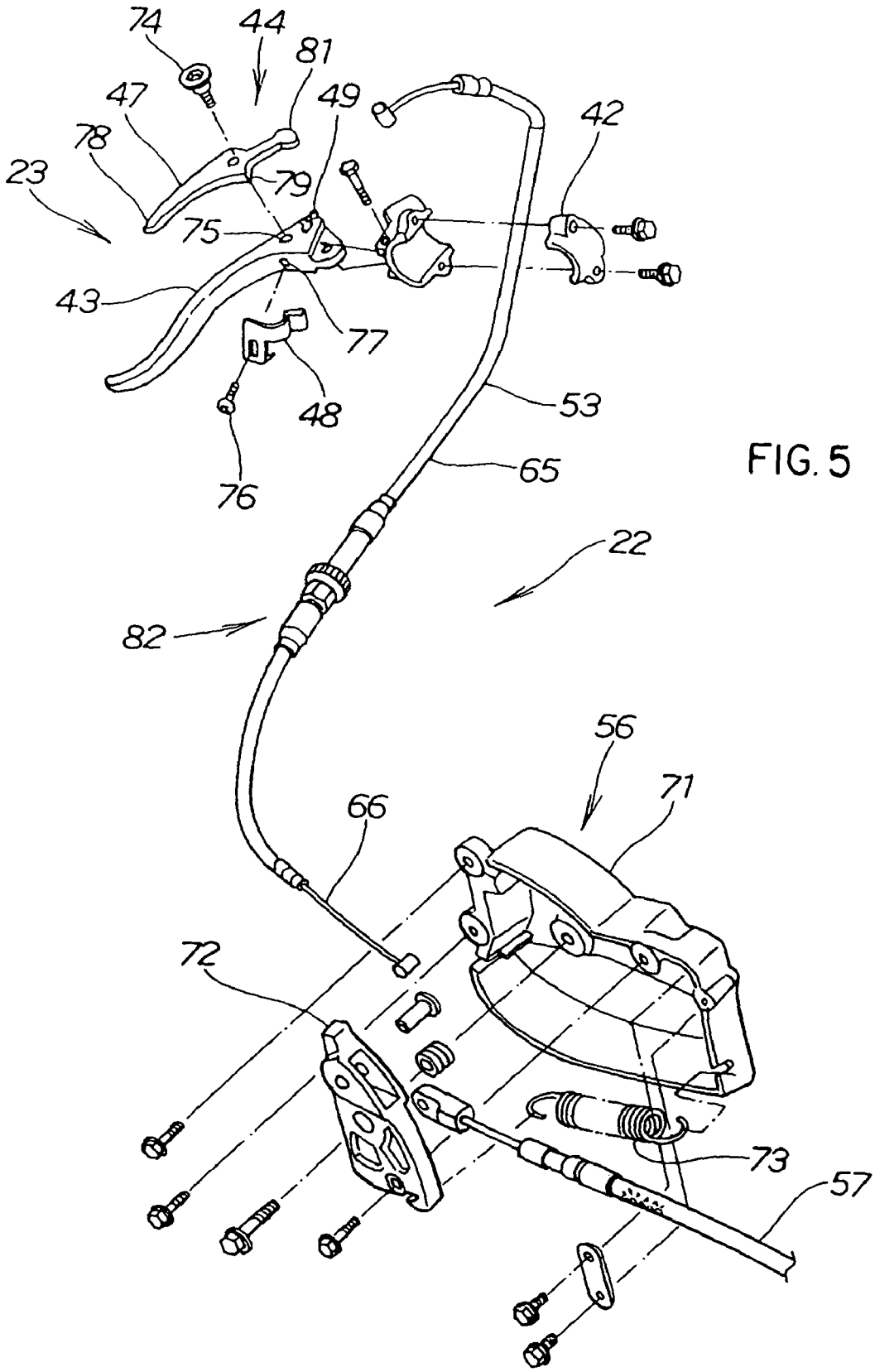
FIG. 5 is an exploded view of the trim operating lever device and the trim operating wire according to the present invention.

FIG. 5 is an exploded view of the trim operating lever device and the trim operating wire according to the present invention, and shows the support member 42 of the trim operating lever device 23, and the trim lever main body 43 oscillatably mounted onto the support member 42, and also shows the lock lever 47, the spring plate 48, and the origin stopper 49 formed on the trim lever main body 43, of the lever lock means 44.

The trim lever main body 43 is provided with a female screw 75 for a small screw 74 for mounting the lock lever 47, and is provided with a female screw 77 for a small screw 76 for mounting the spring plate 48.

The lock lever 47 is provided on its one side with a finger hook portion 78 for hooking of a finger, is provided at its center with a projected portion 79, and is provided on its other side with a latch end portion 81 to be latched on the latch projected portion 51 (see FIG. 3).

FIG. 5 further shows the pull wire 53 of the trim operating wire 22, the push-pull converter 56 (the box 71, the conversion link lever 72, and the tension spring 73), the push wire 57, and an elongation adjusting means 82 provided at the center of the pull wire 53.

Figure 6:
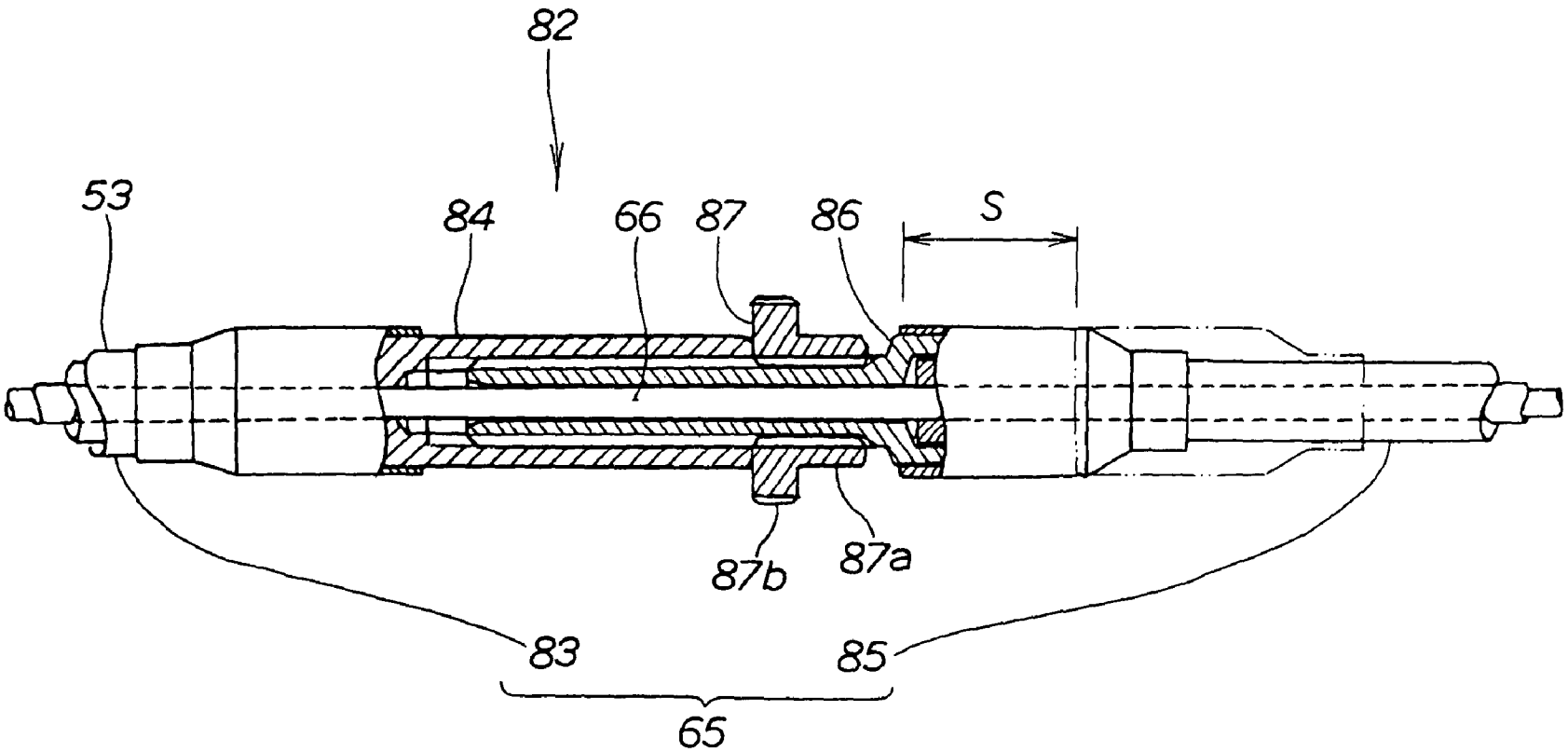
FIG. 6 is a sectional view of an elongation adjusting means according to the present invention.
Figure 7:
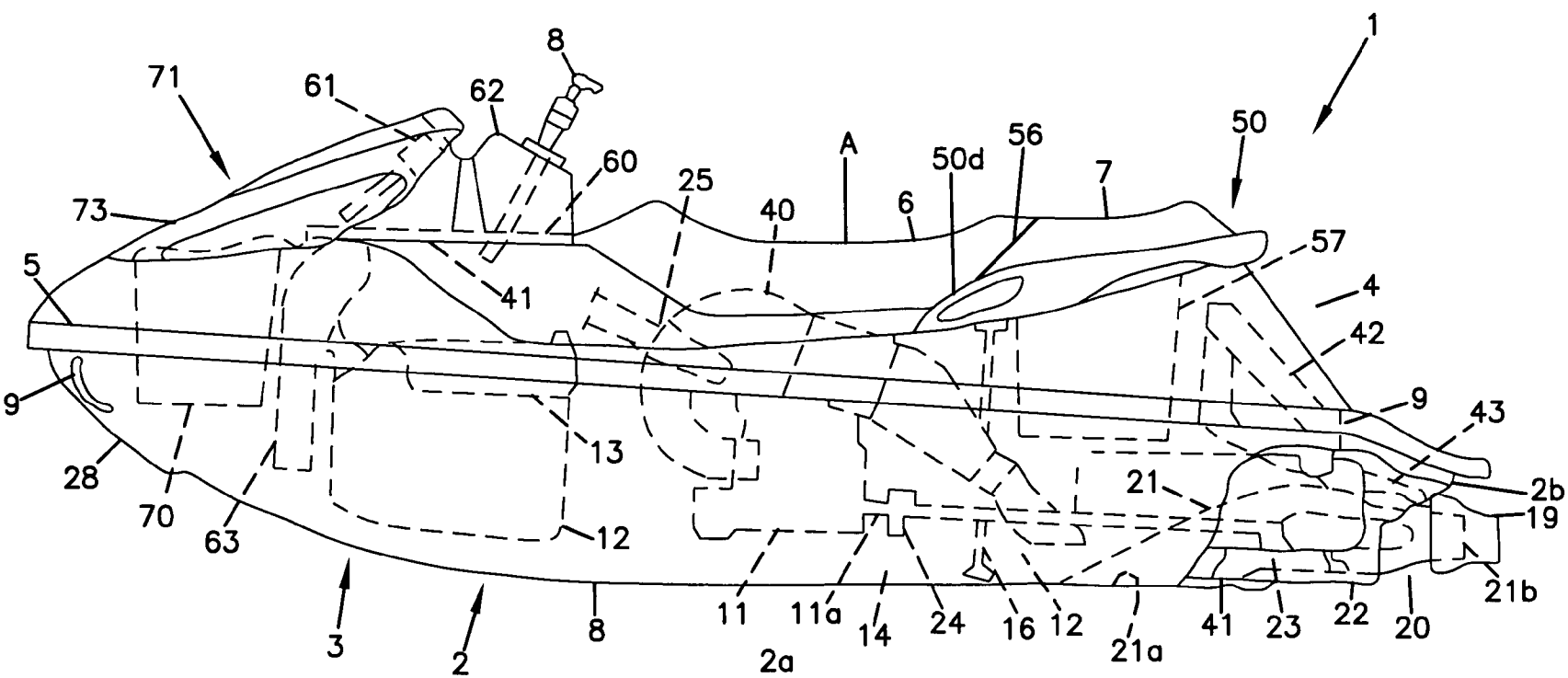
FIG. 7 (PRIOR ART)
FIG. 7 is an illustration of a conventional watercraft configuration.

FIG. 6 is a sectional view of the elongation adjusting means according to the present invention. The elongation adjusting means 82 has a structure in which the wire cable outer 65 of the pull wire 53 is divided into two portions, an adjusting nut 84 is attached to a first wire cable outer 83 located on the side of the trim operating lever device 23 (see FIG. 5), an adjusting bolt 86 is attached to a second wire cable outer 85 located on the side of the push-pull converter 56 (see FIG. 5), and a jam nut 87 is used. Symbol S denotes an adjustment margin.

The jam nut 87, when tightened, functions to prevent the adjusting bolt 86 from being turned idly. The jam nut 87 is comprised of a spanner hook portion 87*a* and a finger hook portion 87*b*, and can be turned by hooking fingers on the finger hook portion 87*b* when there is no tool such as spanner.

The functions of the trim operating wire structure for the personal watercraft as described above will be described below.

Since the push-pull converter 56 is disposed in the craft body on the bow 24 side with regard to the position directly under the steering handle 14 (the position of the axis 25) as shown in FIG. 1, the length of the pull wire 53 connecting between the push-pull converter 56 and the trim operating lever device 23 can be made short, and the push wire 57 can be made long. As a result, even where the pull wire 53, which is thin and highly flexible, is disposed in the state of being bent at several portions thereof, the sliding resistance of the inner wire 66 (see FIG. 4) of the pull wire 53 is small, and operability is enhanced.

In addition, since the length of the wire 53 which is thin and highly flexible is made short, "play" due to bending and delay of response due to elongation of the inner wire 66 are reduced, and operability is enhanced.

On the other hand, the push wire 57 is made long in a rectilinear form, so that the sliding resistance of the inner wire 68 (see FIG. 4) is little changed, and operability can be maintained.

The steering shaft 14*a* for supporting the steering handle 14 as shown in FIG. 1 is disposed in the craft body 11 in the state of being inclined with its upper portion located to the rear of its lower portion, the handle cover 14*b* for covering the steering handle 14 and the steering shaft 14*a* is provided, and the pull wire 53 is disposed on the inside of the handle cover 14*b*. Therefore, the pull wire 53 is passed through the inside of the handle cover 14*b* (see FIG. 3), so that enhancement of appearance is achieved.

In addition, the pull wire 53 disposed along the steering shaft 14*a* is extended forwardly downwards from the steering handle 14, and the push-pull converter 56 is disposed in the place to which the pull wire 53 is extended, so that the pull wire 53 can be made short.

However, one of skill in the art will appreciate that many different configurations of these parts are possible without deviating from the scope of the invention.

We claim:

1. A trim operating wire structure for a personal watercraft comprising:

a jet propeller for ejecting jet water, a nozzle, in position to adjust and capable of adjusting the direction of the jet water, a trim operating lever operably connected to a steering handle, the nozzle being vertically rotatable from a first ordinary direction when the trim operating lever is gripped, and returning to the first ordinary direction when the grip on the trim operating lever is released, a pull wire, a push wire, the push wire long in a rectilinear form, and a push-pull converter, wherein a first end of the pull wire is connected to the trim operating lever and a second end of the pull wire is connected to a first end of the push wire through a push-pull converter, wherein a second end of the push wire is connected to the nozzle, wherein the pull wire has a smaller diameter and is more flexible than the push wire, wherein the push-pull converter is directly under the steering handle.

2. The trim operating wire structure for a personal watercraft of claim 1, further comprising:

a steering shaft for supporting the steering handle, disposed in the personal watercraft in an inclined position with the upper portion of the steering shaft located to the rear of the lower portion of the steering shaft, and a handle cover for covering the steering handle and the steering shaft, wherein the pull wire is disposed on the inside of the handle cover.

3. The trim operating wire structure for a personal watercraft of claim 1, wherein the pull wire is shorter than the push wire.

4. The trim operating wire structure for a personal watercraft of claim 1, wherein the pull wire and the push wire are stainless steel.

5. The trim operating wire structure for a personal watercraft of claim 1, wherein the pull wire is extended forwardly downwards from the steering handle, such that the push-pull converter is disposed at a position where the pull wire is extended.

* * * * *